US006627858B2

(12) United States Patent
Nomura et al.

(10) Patent No.: US 6,627,858 B2
(45) Date of Patent: Sep. 30, 2003

(54) HOT-WATER SUPPLY SYSTEM

(75) Inventors: Satoshi Nomura, Kariya (JP); Hisayoshi Sakakibara, Nishio (JP); Eiji Takahashi, Toyohashi (JP); Tomohisa Yoshimi, Gamagori (JP); Tomoaki Kobayakawa, Tokyo (JP); Kazutoshi Kusakari, Urawa (JP); Michiyuki Saikawa, Zushi (JP)

(73) Assignees: Denso Corporation, Kariya (JP); Tokyo Electric Power Company, Tokyo (JP); Central Research Institute of Electric Power Industry, Tokyo (JP)

( * ) Notice: Subject to any disclaimer, the term of this patent is extended or adjusted under 35 U.S.C. 154(b) by 19 days.

(21) Appl. No.: 09/996,447

(22) Filed: Nov. 28, 2001

(65) Prior Publication Data

US 2002/0125242 A1 Sep. 12, 2002

(30) Foreign Application Priority Data

Dec. 1, 2000 (JP) ..... 2000-367052

(51) Int. Cl.[7] ..... H05B 1/02
(52) U.S. Cl. ..... 219/492; 236/20 R; 392/464
(58) Field of Search ..... 219/482, 483, 219/485, 486, 492, 487, 490, 497, 494, 501, 506, 508; 392/454, 463, 498, 449; 236/12.12, 20 R, 46 R, 78 D, 25 R; 122/14.22, 13.3; 237/8 R, 8 C, 12.3 B; 62/185, 434

(56) References Cited

U.S. PATENT DOCUMENTS

| | | | | | |
|---|---|---|---|---|---|
| 4,508,261 | A | * | 4/1985 | Blank | 392/463 |
| 4,759,497 | A | * | 7/1988 | Cook | 236/20 R |
| 4,834,284 | A | * | 5/1989 | Vandermeyden | 392/449 |
| 5,056,712 | A | * | 10/1991 | Enck | 236/47 |
| 5,598,716 | A | * | 2/1997 | Tanaka et al. | 62/185 |
| 6,350,967 | B1 | * | 2/2002 | Scott | 219/497 |

FOREIGN PATENT DOCUMENTS

| | | | | |
|---|---|---|---|---|
| JP | 58031248 A | * | 2/1983 | F24H/09/20 |
| JP | 63-35904 | | 7/1988 | |
| JP | 09327409 A | * | 12/1997 | A47K/03/00 |
| JP | 2858788 | | 12/1998 | |

* cited by examiner

*Primary Examiner*—Tu Ba Hoang
(74) *Attorney, Agent, or Firm*—Harness, Dickey & Pierce, PLC

(57) ABSTRACT

In a control unit of a hot-water supply system, a boiling time period is estimated based on a hot-water amount stored in a tank at a time of 23:00, a boiling start time is adjusted so that boiling operation is finished at a time immediately before 7:00. For example, when the hot water amount stored in the tank is smaller at the time of 23:00, the boiling time period is made longer and the boiling start time is made earlier. On the other hand, when the hot water amount stored in the tank is larger at the time of 23:00, the boiling time period is made shorter and the boiling start time is made later.

18 Claims, 10 Drawing Sheets

HOT-WATER SUPPLY SYSTEM

CROSS-REFERENCE TO RELATED APPLICATION

This application is related to Japanese Patent Application No. 2000-367052 filed on Dec. 1, 2000, the contents of which are hereby incorporated by reference.

BACKGROUND OF THE INVENTION

1. Field of the Invention

The present invention relates to a hot-water supply system in which water is boiled using electrical power.

2. Description of Related Art

In a conventional hot-water supply system described in JP-B2-2858788 or in JP-B2-63-35904, electrical power is supplied to a heater in a midnight time zone which is cheapest in power rate, so that water is boiled and a hot-water storage tank is filled up in the midnight time zone. Specifically, in the conventional system of JP-B2-2858788, an on-off control of an electrical supply to the heater core is performed at different time zones. On the other hand, in the conventional system of JP-B2-63-35904, the supply of the electrical power to the heater starts from a start time of the midnight time zone.

However, in the-above-described conventional systems, because a hot-water amount to be stored in the tank is limited, the hot-water amount stored in the midnight time zone becomes insufficient in a home using hot water more than the the hot-water amount stored in the tank in a time zone from the morning to the midnight (e.g., 7:00 to 23:00). Accordingly, in the time zone of evening or night, hot water may become short. In this case, when the water is boiled in a time zone except for the midnight time zone, the power rate is increased.

In a home where a small-amount of hot water is used in the time zone from the morning to the midnight (e.g., 7:00 to 23:00) and a large amount of hot water is stayed in the tank at the time of 23:00, the heat radiation of hot water in an unused time period is caused. On the other hand, in a home where a large-amount of hot water is used in one day, a shortage of hot water may be caused.

SUMMARY OF THE INVENTION

In view of the foregoing problems, it is an object of the present invention to provide a hot-water supply system which restricts a wasteful heat radiation of hot water stored in a tank while preventing a shortage of hot water.

According to the present invention, a hot-water supply system includes a tank for storing hot water for a supply, a water-heating unit operated electrically for heating water by performing boiling operation, and a control unit for controlling the boiling operation of the water-heating unit. The control unit includes use heat-quantity calculating means for calculating a heat quantity used in a predetermined time period based on a hot-water supply amount from the tank in the predetermined time period and for learning the heat quantity used in the predetermined time period, target heat-quantity calculating means for calculating a target heat quantity for boiling based on the learned heat quantity in the use heat-quantity calculating means, target temperature calculating means for calculating a target boiling temperature of water based on the target heat quantity calculated by the target heat-quantity calculating means, and boiling means for performing boiling operation of the water-heating unit by a necessary boiling amount based on the target boiling temperature calculated from the target temperature calculating means. In the hot-water supply system, the boiling operation is performed by the necessary boiling amount, it can prevent a wasteful heat radiation of hot water stored in the tank while preventing a shortage of hot water.

Preferably, the control unit further includes time-zone heat-quantity calculating means for calculating and learning a heat quantity used in each time zone based on each hot-water supply amount during a plurality of time zones in which power rate are different from each other, present heat-quantity calculating means for calculating a heat quantity stored in hot water within the tank at the present time, shortage estimating means for estimating a shortage of the heat quantity stored in hot water within the tank based on the heat quantity from the time-zone heat quantity calculating means and the heat quantity from the present heat quantity calculating means, and compulsory-boiling means for additionally performing the boiling operation in accordance with a shortage amount of the heat quantity when the shortage is estimated by the shortage estimating means. Accordingly, a shortage of hot water in each time zone can be prevented.

Preferably, the control unit includes hot-water amount detecting means for detecting a hot-water amount stored in the tank. Further, as the hot-water amount stored in the tank at a start time of the midnight time zone is smaller, the first boiling time period is set longer and the first boiling start time is set earlier. Therefore, the boiling operation can be accurately finished before the finish of the midnight time zone. Accordingly, heat loss in the midnight time zone can be prevented.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

Figure 1:
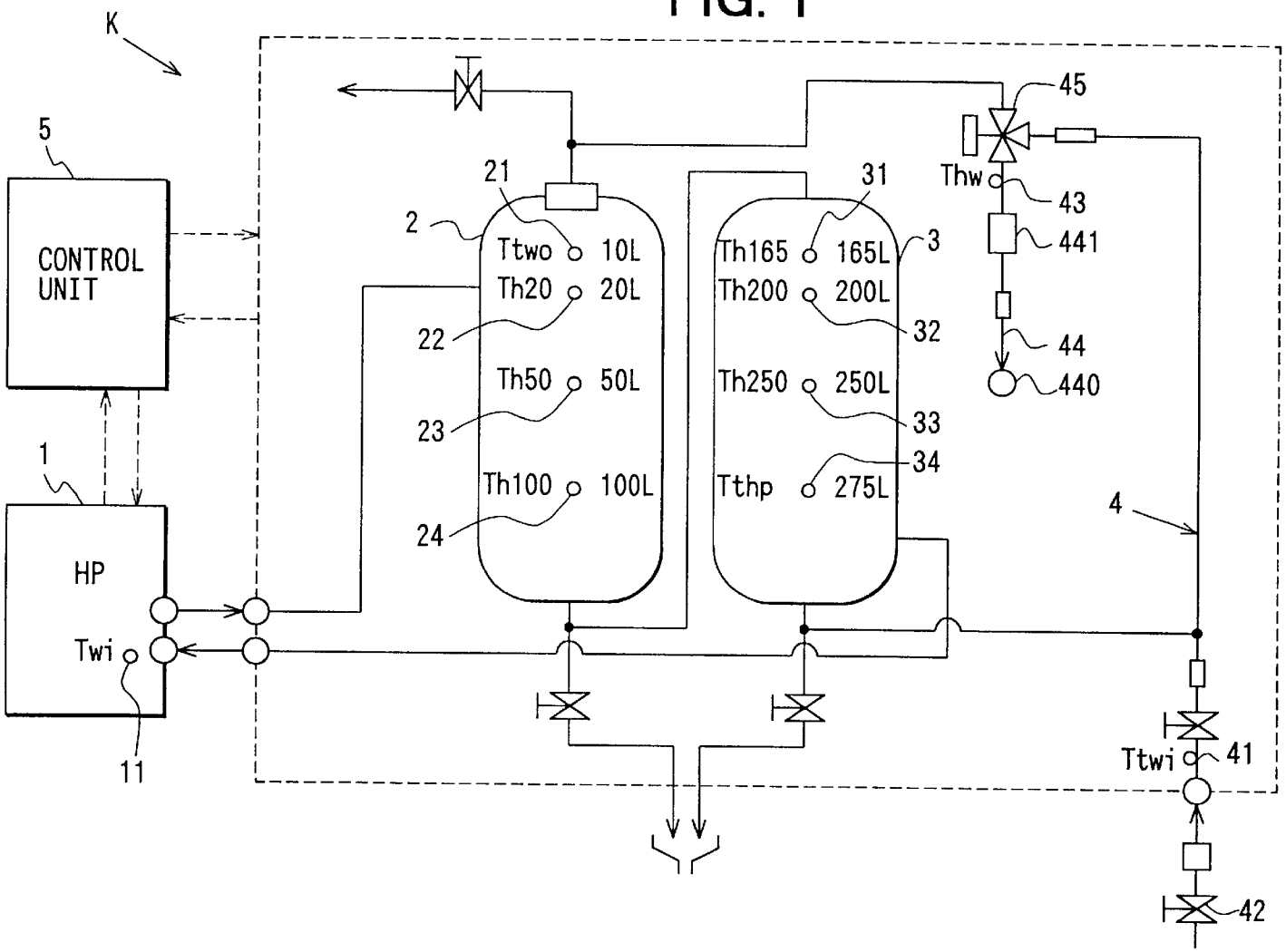
FIG. 1 is a schematic diagram showing a hot-water supply system according to a first preferred embodiment of the present invention.

A first preferred embodiment of the present invention will be now described with reference to FIGS. 1–10. As shown in FIG. 1, a hot-water supply system K includes a heat pump unit (HP unit) 1 for heating water by performing water-heating operation (boiling operation). In the heat pump unit 1, refrigerant is compressed by an electrical compressor, and water is heated by using a condensation heat of refrigerant to have a temperature of about 90° C. in maximum. In the first embodiment, carbon dioxide is used as refrigerant, for example.

Double-pipe type tanks 2, 3 are disposed to store hot water heated by the heat pump unit 1. By operation (boiling operation) of about 6 hours of the heat pump unit 1, hot water is fully stored in the tanks 2, 3. In the first embodiment, both the tanks 2, 3 are fully filled with hot water of about 300 liters.

A thermistor 11 is disposed in the heat pump unit 1 at a water supply side to detect a water temperature Twi flowing into the heat pump unit 1. When the thermistor 11 detects the water temperature Twi higher than a predetermined high temperature (Tp−10° C.), it can be determined that the tanks 2, 3 are filled with hot water. A thermistor 21 is disposed to detect a water temperature Ttwo stored at a top portion of the tank 2. That is, the thermistor 21 can detect a water temperature flowing out from the heat pump unit 1. Thermistors 22–24 are also disposed in the tank 2 to detect a hot-water storage amount stored in the tank 2. For example, the thermistors 22–24 are disposed at positions of 20 liters (20L), 50 liters (50L) and 100 liters (100L), respectively. In addition, thermistors 31–33 are disposed in the tank 3 to detect the hot-water storage amount stored in the tank 3. For example, the thermistors 31–33 are disposed at positions of 165 liters (165L), 200 liters (200L) and 250 liters (250L), respectively. A thermistor 34 is disposed in the tank 3 to detect a water temperature Tthp to be introduced into the heat pump unit 1. Therefore, the thermistor 34 is also used as a filling detection sensor for detecting the filling of hot water in the tanks 2, 3.

A thermistor 41 is disposed in a water supply pipe 4 at a position downstream from a water valve 42 to detect a water supply temperature Ttwi. A thermistor 43 is disposed in a hot-water supply pipe 44 to detect a hot-water supply temperature Thw supplied to a user or a both. A hot-water flow counter 441 is disposed to detect a using amount of hot water. By using the hot-water supply temperature Thw and the hot-water using amount detected by the counter 441, a used heat quantity Q can be calculated.

A temperature adjustment valve 45 is disposed to adjust temperature of hot water supplied to the user or the bath at a set temperature set Tset by a temperature setting unit (not shown). A control unit 5 is disposed to control the operation of the adjustment valve 45 so that the hot-water supply temperature becomes the set temperature Tset set by the temperature setting unit.

The control unit 5 calculates a water mixing ratio based on the water supply temperature Twio flowing into the heat pump unit 1 and the water temperature Ttwo flowing out from the heat pump unit 1, and adjusts the temperature Thw of hot water (warm water) flowing from a water cock 440 (Karann) or a shower head. Here, the control unit 5 performs a feed-back control to finely adjust the water mixing ratio so that the supply water temperature Thw becomes the set temperature Tset.

Figure 2:
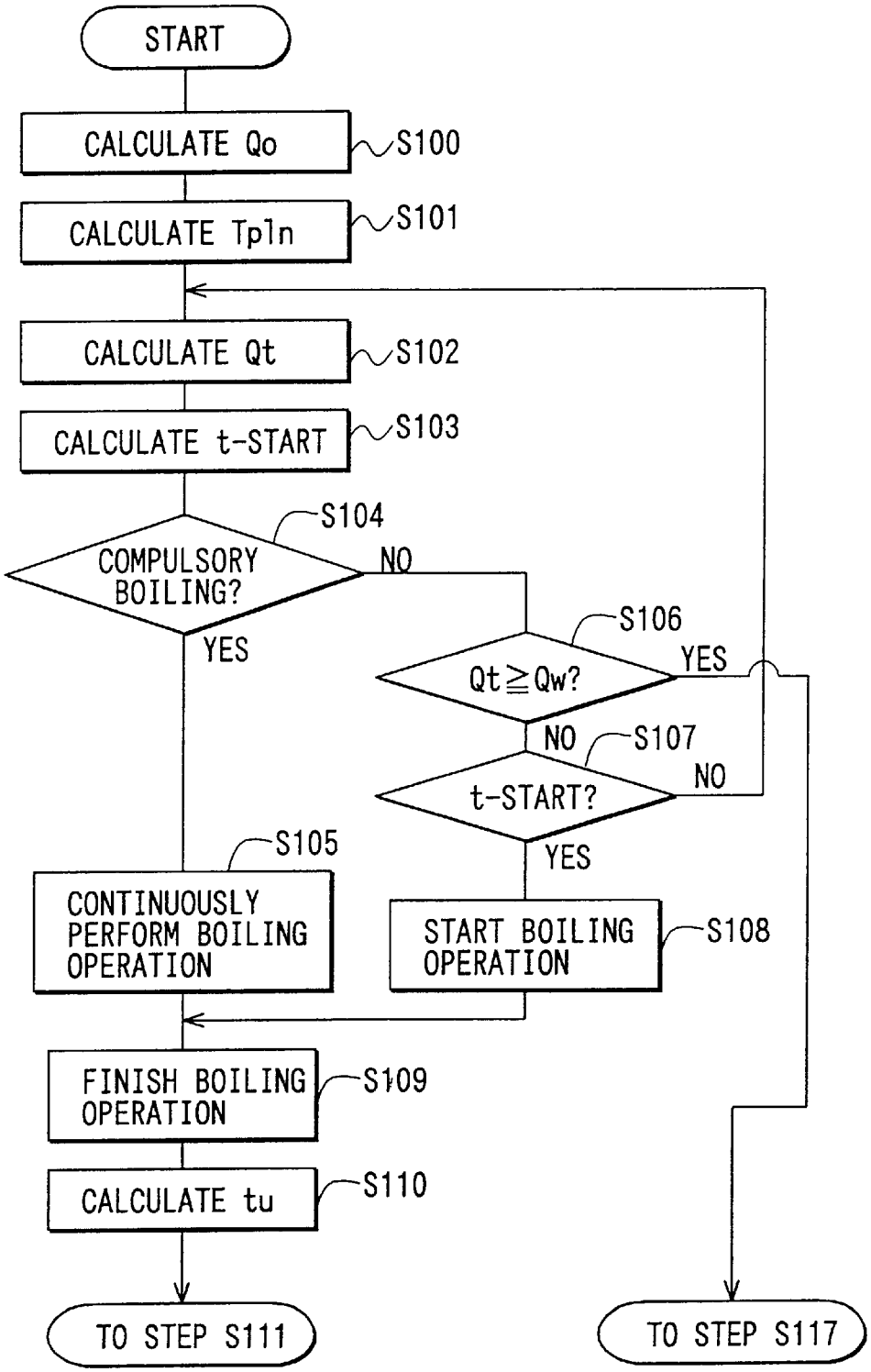
FIG. 2 is a flow diagram showing a part of control operation of a control unit of the hot-water supply system according to the first embodiment.

Next, boiling operation (heating operation) of water in the hot-water supply system K will be described with reference to the flows diagrams in FIGS. 2–4. In the present invention, boiling operation performed in the midnight time zone which is cheapest in power rate is as a general boiling operation (first boiling operation). On the other hand, in this case that the hot-water using amount by the user is large and the hot-water storage amount is insufficient, boiling operation additionally performed in the other time zone except for the midnight time zone is as compulsory boiling operation (second boiling operation). First, at step S100, a maximum using heat quantity Qo during the last seven days is calculated. First, a heat quantity used for each one liter water is calculated based on the following formula (1).

$$Qs1L=(Thw-THWA)\times SP/CL \quad (1)$$

wherein, Qs1L is the heat quantity used for the water of 1 liter, Thw is a hot-water supply temperature to a user or a bath, THWA is a mean water-supply temperature, SP is a specific gravity, and CL is a heat-radiation loss coefficient (e.g., 0.9).

The mean water-supply temperature THWA is the mean value of the water temperature Ttwi supplied to the tank 3, and is used as a standard water temperature. The flow amount of hot water is detected by the hot-water flow counter 441, a production of water supply temperature per a predetermined time is performed, and the mean value of the water-supply temperature is calculated at a time just passing the time of 23:00. The specific gravity SP is a constant value converting from the temperature to the heat quantity, and can be calculated using the formula (2).

$$SP=(-2\times10^{-6}\times Thw^2-2.7\times10^{-4}\times Thw+1.0058) \quad (2)$$

wherein, Thw is the hot-water supply temperature supplied to the user or the bath.

Next, the heat-quantity production is calculated based on the following formula (3), using the heat quantity Qs1L calculated in the formula (1) every when the flow amount of hot water of 1 liter is detected by the hot-water flow counter 441.

$$Qday=\Sigma Qs1L \quad (3)$$

wherein Qday is the heat quantity used in one day from 23:00 of the preceding day to 23:00 of the set day. That is, Qday is the production value of the heat quantity used for water of per one liter in one day.

Figure 5:
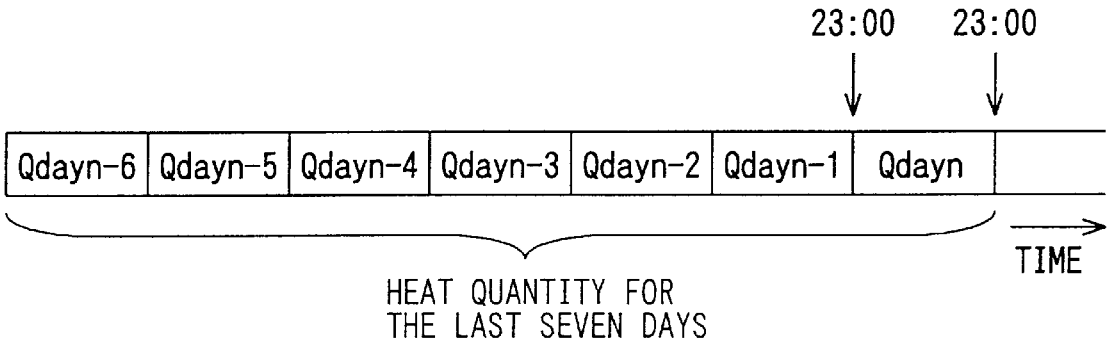
FIG. 5 is a view for calculating a maximum using amount of heat quantity from a consumed heat quantity of each one day for the last seven days, according to the first embodiment.

Further, as shown in FIG. 5, when the heat quantities used for each one day in the last seven days are set as Qdayn, Qdayn-1, Qdayn-2, Qdayn-3, Qdayn-4, Qdayn-5, and Qdayn-6, the maximum heat quantity Qo used in one day during the last seven days is calculated based on the following formula (4).

$$Qo=Max\ (Qdayn,\ Qdayn\text{-}1,\ Qdayn\text{-}2,\ Qdayn\text{-}3,\ Qdayn\text{-}4,\ Qdayn\text{-}5,\ Qdayn\text{-}6) \quad (4)$$

Here, the maximum heat quantity Qo is used as a target heat storage amount Qw (target heat quantity) for preventing a water shortage. In the first embodiment, the mean value of the heat quantity used during the last seven days can be used as the target heat storage amount Qw. Alternatively, the target heat storage amount Qw can be calculated based on the heat quantity used during predetermined days without being limited to the last seven days.

Next, at step S101, a learning temperature Tpln of hot water stored in the tanks 2, 3 is calculated using the formula (5).

$$Tpln=Qo/[(L-Lo)\times 4.18\times SP1]+THWA \quad (5)$$

wherein, L is the maximum water storage amount (e.g., 300L) of the tanks 2, 3, Lo is a required minimum hot-water amount, SP1 is a specific gravity different from that of the above-described formula (2). That is, in formula (5), the specific gravity SP1 is a converting coefficient for calculating a necessary temperature using the hot water amount and the heat quantity. In the first embodiment, the specific gravity SP1 is set at 0.96, and the calculated Tpln is restricted in a range of 65–90° C. When the learning temperature Tpln is lower than 65° C., it is difficult to make a required hot water. On the other hand, when the learning temperature Tpln is higher than 90° C. to be proximate to 100° C., boiling may be caused in the tanks 2, 3.

Next, at step S102, heat quantity Qt of hot water stored in the tanks 2, 3 at the present time is calculated using the formula (6).

$$Qt=Lt\times(Tavg-THWA)\times SP2\times 4.18 \quad (6)$$

wherein Lt is the amount of hot water stored in the tanks 2, 3, Tavg is the mean temperature of hot water in the tanks 2, 3, THWA is the mean temperature of supply water temperature (standard water temperature), and SP2 is a specific gravity.

First, the amount Lt of hot water stored in the tanks 2, 3 is calculated. That is, using the eight thermistors 22–24, 31–34 disposed in the eight positions in the tanks 2, 3, the amount Lt is calculated in accordance with a temperature difference between both detection positions.

Figure 6:
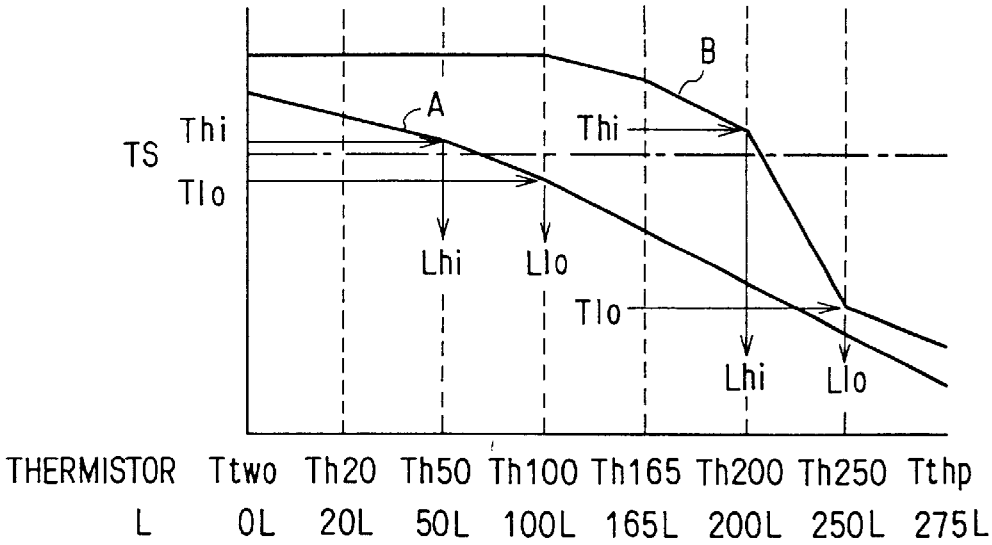
FIG. 6 is a graph for performing a calculation of a hot-water storage amount Lt in a take, according to the first embodiment.

When the temperature difference between both detection positions in the tanks 2, 3 is equal to or lower than 20° C., the amount Lt is calculated in accordance with the following formula (7) based on the characteristic graph A in FIG. 6.

$$Lt=Lhi+(Thi-TS)\times(Llo-Lhi)/(Thi-Tlo) \quad (7)$$

On the other hand, when the temperature difference between both detection positions is larger than 20° C., the amount Lt is calculated in accordance with the following formula (8) based on the characteristic graph B in FIG. 6.

$$Lt=Lhi+(Llo-Lhi)/2 \quad (8)$$

In the first embodiment, when Twi>Tp−10° C., it can determined that the tanks 2, 3 are filled with hot water.

Next, the mean temperature Tavg of hot water in the tanks 2, 3 is calculated. First, among the thermostors (sensors) Th20, Th50, Th100, Th165, Th200, Th250, Tthp, thermostors for detecting the temperature higher than a determination temperature TS for determining the hot-water storage amount are detected. Then, the mean temperature Tavg of hot water in the tanks 2, 3 is calculated based on the following formula (9).

$$Tavg=f(Th20,\ Th50,\ Th100,\ Th165,\ Th200,\ Th250,\ Tthp,\ TS) \quad (9)$$

Next, the specific gravity SP2 in the formula (6) is calculated based on the following formula (10).

$$SP2=(-2\times10^{-6}\times Tavg^2-2.7\times10^{-4}Tavg+1.0058) \quad (10)$$

Here, the determination temperature (determination value) TS is (0.6×Tp+11), and the target boiling temperature Tp is (Tpln+5). That is, TS=0.6×Tp+11, and Tp=Tpln+5.

The control unit 5 can calculate the target boiling temperature Tp based on the target heat storage amount Qw (a target boiling heat quantity).

Next, at step S103, the general-boiling start time t-START and general-boiling time period tw are calculated. That is, the general-boiling start time t-START is calculated based on the following formula (11), so that the general-boiling operation for obtaining the target heat storage amount Qw is finished at the time of am 7:00.

$$t\text{-}START=7{:}00-tw \quad (11)$$

wherein, the general-boiling start time is set later than 23:00, and tw indicates the general-boiling time period.

The general-boiling time period tw is calculated based on the following formula (12).

$$tw=Lw/[Qa/(Tp-THWA)/4.18/SP3] \quad (12)$$

wherein, Lw is a necessary general-boiling amount (i.e., Lw=300−Lt), Qa is the boiling capacity, Tp is the target boiling temperature, and SP3 is a specific gravity. In the first embodiment, the boiling capacity Qa is 4.5 kW in the midnight operation, and the specific gravity SP3 is $(-2\times10^{-6}\times Tp^2-2.7\times10^{-4}\times Tp+1.0058)\times3600$.

That is, the control unit 5 calculates the control operation of steps S100–S103 from a time of before 23:00 to a time of 23:00 (e.g., from 22:59 to 23:00).

After time of 23:00, the boiling control in the midnight time zone is performed. That is, at step S104, it is determined whether or not the operation is in the compulsory boiling operation. When the compulsory boiling operation is determined at step S104, the boiling operation is continuously performed at step S105. However, when a boiling finishing condition is satisfied at step S105, the boiling operation is stopped. Specifically, when the water temperature Twi flowing into the heat pump unit 1 is higher than (Tp−10° C.), or when the midnight time zone is finished, the boiling operation is finished. Here, when the water temperature Twi flowing into the heat pump unit 1 is higher than (Tp−10° C.), it is determined that the tanks 2, 3 are fully filled with hot water.

On the other hand, when the compulsory-boiling operation is not determined at step S104, it is determined whether or not the heat storage amount Qt stored in the tanks 2, 3 is sufficient or insufficient. When the heat storage amount Qt is equal to or larger than the target heat storage amount Qw, it is determined that the heat storage amount Qt stored in the tanks 2, 3 is sufficient. On the other hand, when the heat storage amount Qt is smaller than the target heat storage amount Qw, it is determined that the heat storage amount Qt stored in the tanks 2, 3 is insufficient. When it is determined that the heat storage amount Qt stored in the tanks is sufficient at step S106, the general-boiling operation in the midnight time zone is not performed, and a maximum heat quantity Qmn in a time zone from 17:00 to 23:00 is calculated at step S117 in FIG. 3.

When it is determined that the heat storage amount Qt stored in the tanks 2, 3 is insufficient at step S106 (Qt<Qw), it is determined whether or not it is at the boiling start time t-START. When the time becomes the boiling start time t-START in the midnight time zone at step S107, the general boiling operation is started at step S108, and the general boiling operation is performed until the next time zone of 7:00. That is, the control operations of steps S104–S108 are performed in the midnight time zone until the next time zone of 7:00. After the time of 7:00, the boiling operation is finished at step S109. Next, at step S110, a compulsory-boiling time period tu is calculated. The compulsory boiling time period tu is calculated based on the following formula (13) during a time zone except for the midnight time zone to the midnight time zone.

$$tu=Lu/[Qa/(Tp-THWA)/4.18/SP3] \quad (13)$$

wherein, tu is the compulsory boiling time period for which the compulsory-boiling operation is performed, Lu is a necessary compulsory-boiling amount, Qa is the boiling capacity, and Tp is the target boiling temperature, THWA is the mean water supply temperature, and SP3 is $(-2\times10^{-6}\times Tp^2-2.7\times10^{-4}\times Tp+1.0058)\times3600$.

The necessary compulsory-boiling amount Lu is calculated based on the following formula (14).

$$Lu=Qo/[(Tp+10-THWA)\times SP4\times4.18]+Lset-(Lt+25) \quad (14)$$

wherein SP4 is a specific gravity, and SP4 is 0.965.

Figure 3:
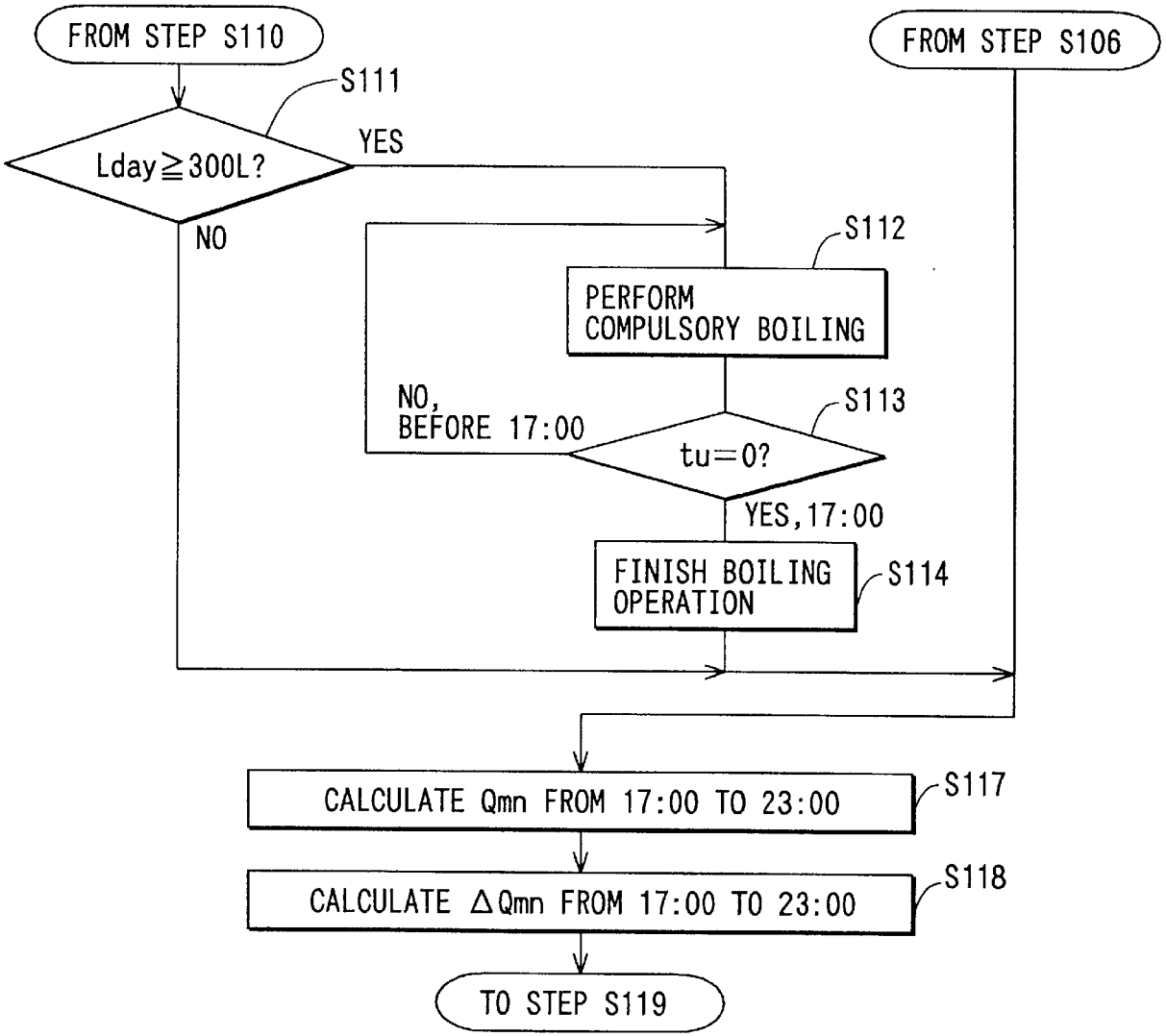
FIG. 3 is a flow diagram showing a part of control operation of the control unit of the hot-water supply system according to the first embodiment.
Figure 4:
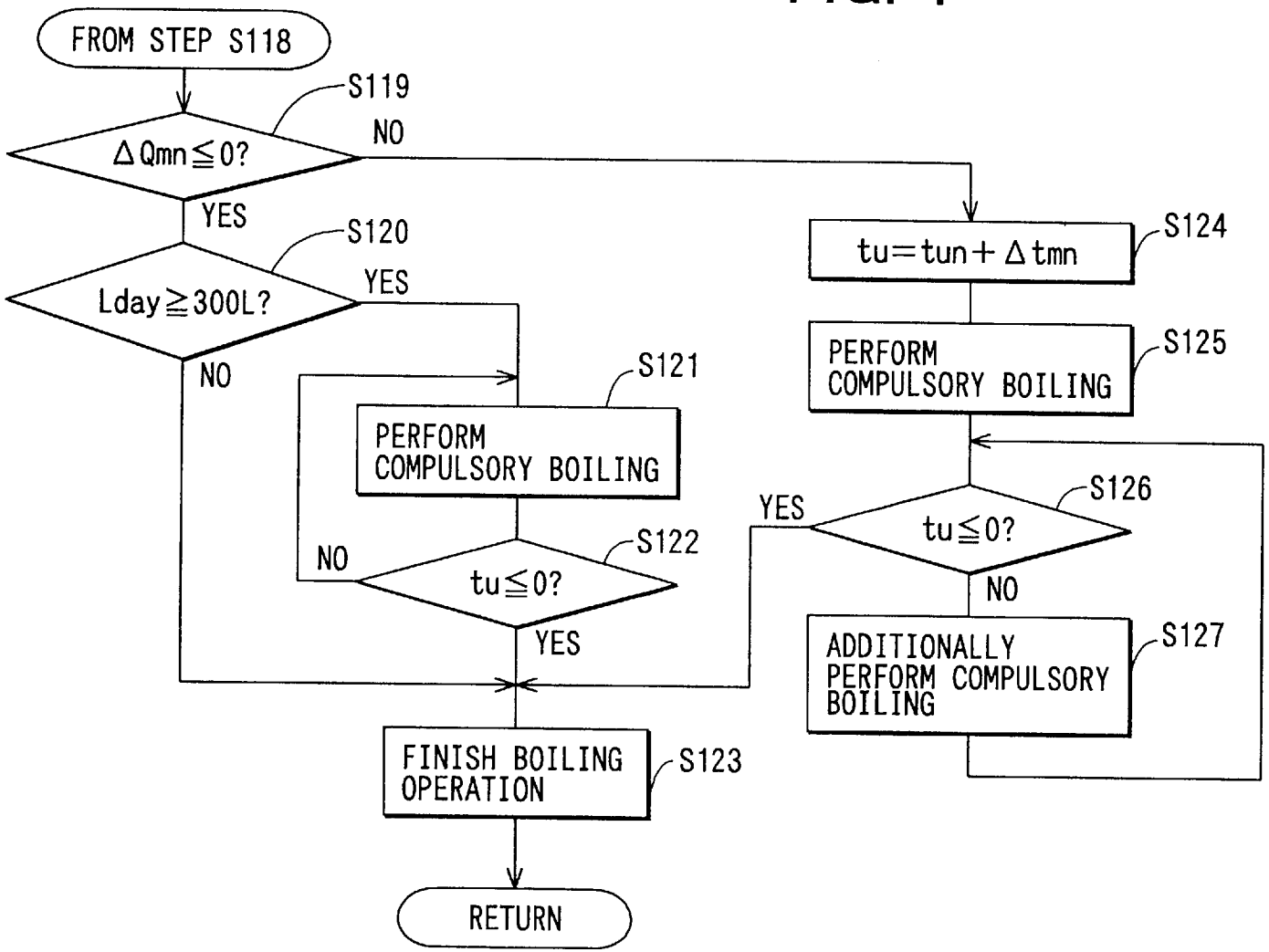
FIG. 4 is a flow diagram showing a part of control operation of the control unit of the hot-water supply system according to the first embodiment.

Thereafter, at step S111 in FIG. 3, it is determined whether or not a hot-water using amount Lday in one day is calculated by using the production value of the hot-water flow counter 441 at step S100.

When the hot-water using amount Lday in one day is equal to or larger than a predetermined amount (e.g., 300 liters), it is determined that the compulsory-boiling operation is need. Accordingly, in the time zone from 7:00 to 17:00, when the hot-water using amount Lday in one day is equal to or larger than the predetermined amount (e.g., 300L) at step S111, the compulsory-boiling operation is performed at step S112 when the hot-water indicating amount Ltd is smaller than 200L, until the hot-water indicating amount Ltd becomes 275L.

When the hot water is not used in the time zone of 7:00–17:00, the compulsory-boiling operation is not performed. Accordingly, in the first embodiment, at step S112, the compulsory-boiling operation is performed when the hot-water amount stored in the tanks is smaller than 200 liters, and the compulsory-boiling operation is stopped once after the hot-water amount stored in the tanks becomes equal to 275 liters.

In the compulsory-boiling operation, the compulsory-boiling time period tu is decreased by the operation time of the compulsory-boiling operation. On the other hand, when the compulsory-boiling operation is stopped, the remain compulsory-boiling time period tu is maintained, and is not decreased. Next, at step S113, it is determined whether or not the compulsory-boiling time period tu becomes zero. That is, at step S113, it is determined whether or not the compulsory-boiling operation time passes the time period tu. When the compulsory-boiling operation time does not pass the compulsory-boiling time period tu or when it is at a time of before 17:00, the control program returns to step S112. When the compulsory-boiling operation time passes the compulsory-boiling time period tu or when it is at the time of 17:00, the compulsory-boiling operation in the time zone from 7:00 to 17:00 is finished at step S114. The control unit 5 performs the control operation of steps S111–S114 in the time zone from 7:00 to 17:00.

After 17:00, the control operation at step S117 is performed. That is, at step S117, the maximum using heat amount Qmn for the last seven days in the time zone from 17:00 to 23:00 is calculated similarly to the calculation method of Qo. Next, at step S118, a shortage heat quantity ΔQmn in the time zone from 17:00 to 23:00 is calculated based on the following formula (15).

$$\Delta Qmn=(Q_{7-17}+Qmn)-(Qo+QLset) \quad (15)$$

wherein, $Q_{7-17}$ is the heat quantity used today in the time zone from 7:00 to 17:00, QLset is the heat quantity corresponding to the minimum hot-water storage amount. Here, the production value of heat quantity used today from 7:00 to 17:00 is calculated as the heat quantity $Q_{7-17}$. In addition, QLset is also calculated based on the following formula (16) similarly to the calculation of Qt.

$$QLset=Lset\times(Tavg-THWA)\times SP2\times4.18 \quad (16)$$

wherein SP2 is a specific gravity.

Next, at step S119, it is determined whether or not ΔQmn is equal to or smaller than 0. When it is determined that ΔQmn is equal to or smaller than 0 (ΔQmn≦0), it is determined that the shortage heat quantity is not caused in the time zone from 17:00 to 23:00, and the control at step S120 is performed. On the other hand, when it is determined that ΔQmn is larger than 0 (ΔQmn>0), it is determined that the shortage heat quantity is caused in the time zone from 17:00 to 23:00, and the control at step S124 is performed.

The control operations of steps S120–S123 in the time zone from 17:00 to 23:00 are similar to those at steps S111–S114 in the time zone from 7:00 to 17:00. That is, at step S120–S123, in the time zone from 17:00 to 23:00, the compulsory-boiling operation is additionally performed when the compulsory-boiling time period tu in the time zone from 7:00 to 17:00 remains.

On the other hand, at step S124, the compulsory-boiling time period tu is changed based on the following formula (17).

$$tu=tun+\Delta tmn \quad (17)$$

wherein, tun is the remaining compulsory-boiling time period tu in the time zone from 7:00 to 17:00, and Δtmn is an additional compulsory-boiling time period corresponding to the shortage heat quantity ΔQmn. For example, a shortage compulsory-boiling amount ΔLmn is calculated from the shortage heat quantity ΔQmn, and the additional compulsory-boiling time period Δtmn is calculated by using the shortage compulsory-boiling amount ΔLmn and the boiling capacity (e.g., 5.5 kW) in this time zone.

When it is estimated that the heat quantity is insufficient in the time zone of from 17:00 to 23:00 which is the peak time zone using the hot water, the necessary time period Δtmn is added in the remain compulsory-boiling time period tu remaining in the time zone from 7:00 to 17:00 so that the shortage heat quantity ΔQmn is obtained. The additional compulsory-boiling time period Δtmn is calculated using the following formulas (18) and (19).

$$\Delta tmn=\Delta Lmn/[5.5\ \text{kW}/(Tpln-THWA)/4.18/SP] \quad (18)$$

$$\Delta Lmn=\Delta Qmn/[5.5\ \text{kW}/(Tpln-THWA)\times 4.18\times SP] \quad (19)$$

wherein SP is a specific gravity.

Next, at step S125, the compulsory-boiling operation is performed once until the hot-water storage indicating amount Ltd is 300L. That is, at step S125, the compulsory-boiling operation is performed so that the tanks are fully filled with hot water. Next, at step S126, it is determined whether or not the compulsory-boiling time period tu is finished in the time zone from 17:00 to 23:00. When the compulsory-boiling operation time passes the compulsory-boiling time period tu (tu≦0), the compulsory-boiling operation in the time zone from 17:00 to 23:00 is finished at step S123. On the other hand, when the compulsory-boiling time period tu remains (tu>0) at step S126, the compulsory-boiling operation is performed at step S127 when the hot-water indicating amount Ltd is smaller than 200L, until the hot-water indicating amount Ltd becomes 300L. The control unit 5 performs the control operation at steps S119–S127 in the time zone from 17:00 to 23:00.

Next, the advantages of the hot-water supply system K according to the first embodiment will be now described.

In a case that the hot-water using amount in one day is equal to or larger than the maximum hot-water storage amount (e.g., 300L) in a home, when the tanks 2, 3 are always filled with hot water in a time zone except for the midnight time zone, the power rate becomes high. However, in the hot-water supply system K of the first embodiment, the compulsory-boiling time period tu in the time zone from 7:00 to 17:00 is calculated at step S110, and the compulsory-boiling operation is performed at step S112 in the time zone from 7:00 to 17:00 when the hot-water using amount in one day is equal to or larger than the maximum hot-water storage amount (e.g., 300L) in the home. Accordingly, even when the hot-water using amount in one day is equal to or larger than the maximum hot-water storage amount (e.g., 300L) in the home, the tanks 2, 3 are not fully filled with hot water in a time zone except for the midnight time zone, and the power rate can be decreased. That is, at step S112, the compulsory-boiling operation is performed when the hot-water storage amount becomes smaller than 200L, and is stopped when the hot-water storage amount is increased to 275L. Therefore, the hot water can be effectively stored while the power rate is restricted.

Figure 8:
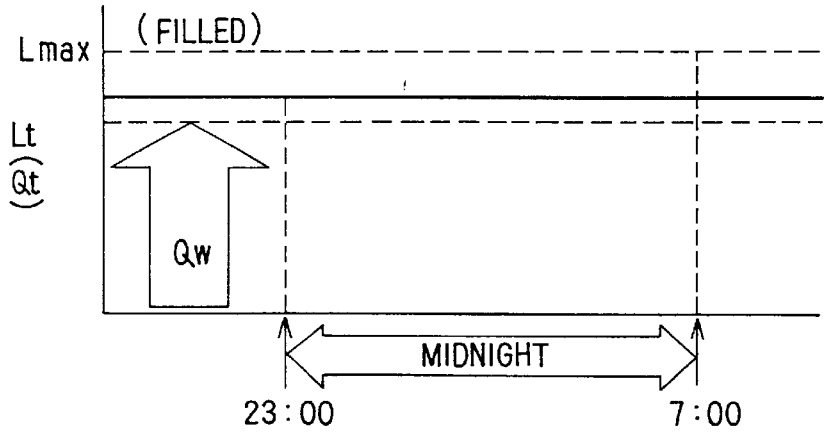
FIG. 8 is a graph for explaining a relationship between the hot-water storage amount Lt and a target heat storage amount Qw, according to the first embodiment.

In a home where the hot-water using amount is small, when the tanks 2, 3 are fully filled with the hot water, heat-radiation (heat loss) of the unused hot water causes. However, in the hot-water supply system K of the first embodiment, at step S106, it is determined whether the heat storage amount Qt at the present time is larger than the target heat storage amount Qw at the time of 23:00. When the heat storage amount Qt is larger than the target heat storage amount Qw at the time of 23:00, the tanks are not fully filled with the hot water even in the midnight time zone. That is, as shown in FIG. 8, even when a predetermined hot-water amount Lp smaller than the fully filled amount Lmax is stored in the tanks, when the heat storage amount Qt corresponding to Lp is larger than the target heat storage amount Qw, the tanks 2, 3 are not fully filled with hot water. Therefore, in the home where the hot-water using amount is small, heat-radiation of the unused hot water can be made smaller.

Figure 7A:
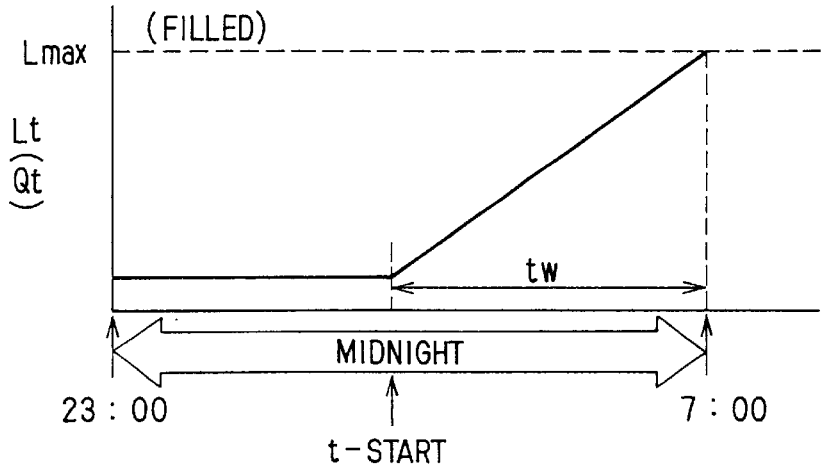
FIG. 7A is a graph showing a boiling start time (t-START) when the hot-water storage amount at time of 23:00 is small.
Figure 7B:
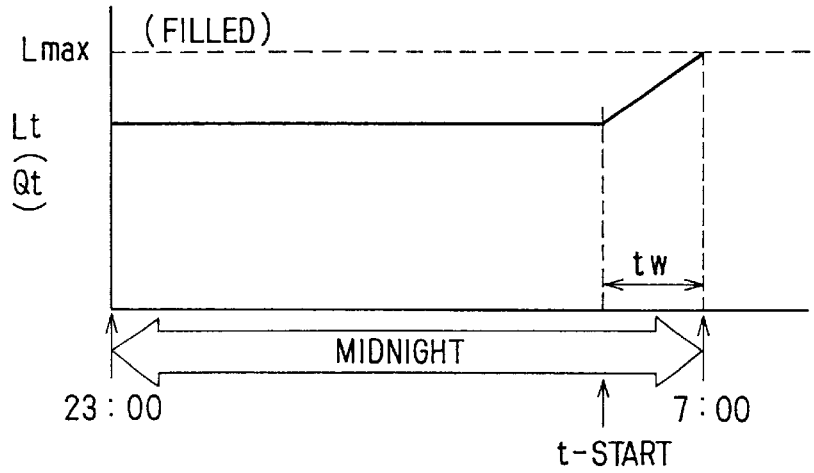
FIG. 7B is a graph showing the boiling start time (t-START) when the hot-water storage amount at time of 23:00 is large.

When the tanks are fully filled with hot water in a middle time in the midnight time zone, the heat loss of hot water is caused in the midnight time zone. However, in the first embodiment of the present invention, the heat loss of the hot water in the midnight time zone can be made small by performing the control operations at steps S100–S103, S107, S108. Specifically, when the hot-water storage amount Lt is smaller at the time of 23:00 as shown in FIG. 7A, the general-boiling time period tw is made longer, and the general-boiling start time t-START is made earlyer. On the other hand, when the hot-water storage amount Lt is larger at the time of 23:00 as shown in FIG. 7B, the general-boiling time period tw is made shorter, and the general-boiling start time t-START is made later. That is, the general-boiling start time t-START is adjusted, so that the tanks are filled with hot water at a time immediately before the finish of the midnight time zone. Accordingly, the heat loss in the midnight time zone can be restricted in maximum.

In addition, in the first embodiment of the present invention, at the time of 17:00, the compulsory-boiling time period tu is also calculated, and the compulsory-boiling operation is additionally performed when the heat quantity of hot water used in the time zone from 7:00 to 17:00 is larger than a predetermined amount. Therefore, it can prevent a shortage of hot water in the night time zone from 17:00 to 23:00 that is the mainly using time zone of hot water.

Figure 9:
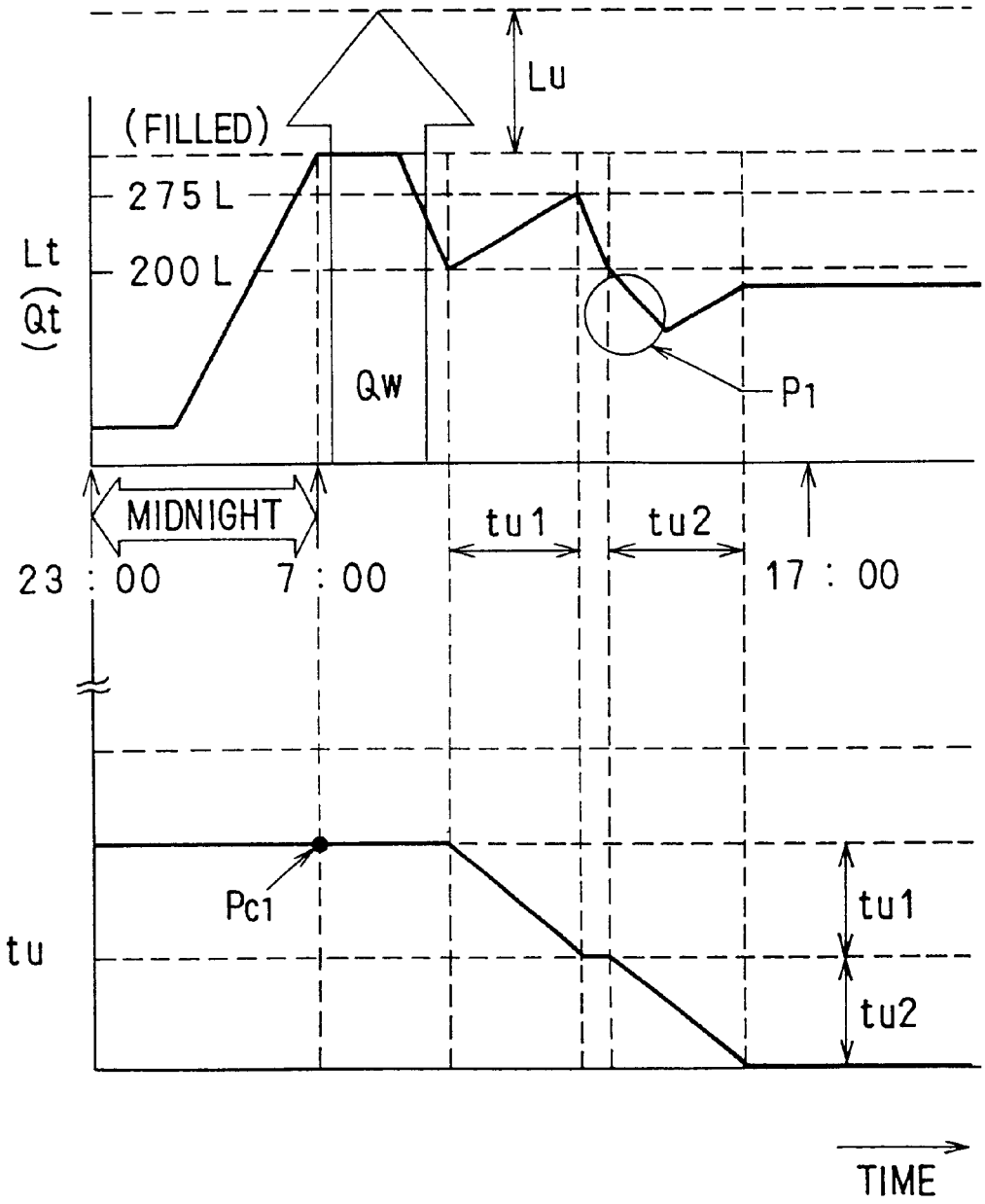
FIG. 9 is a graph showing a change of the hot-water storage amount Lt (heat storage amount Qt), and a change of a compulsory-boiling time period tu, in a time zone from 7:00 to 17:00, according to the first embodiment.

FIG. 9 shows control operation of the compulsory-boiling time period tu (tu1, tu2) in the time zone from 7:00 to 17:00. As shown in FIG. 9, when the hot-water using amount becomes larger and the hot-water storage amount Lt becomes smaller than 200L, the compulsory-boiling operation is performed during a first time period tu1 in the compulsory-boiling time period tu, in the time zone from 7:00 to 17:00. When the hot-water storage amount Lt becomes smaller again than 200L after compulsory-boiling operation is performed during the first time period tu1, the compulsory-boiling operation is further performed during a second time period tu1 remaining in the compulsory-boiling time period tu, in the time zone from 7:00 to 17:00. In FIG. 9, at the point P1, the compulsory-boiling operation is performed while the hot water is used. In addition, at the point Pc1 (time 7:00), the compulsory-boiling time tu for the time zone from 7:00 to 17:00 is calculated.

Figure 10:
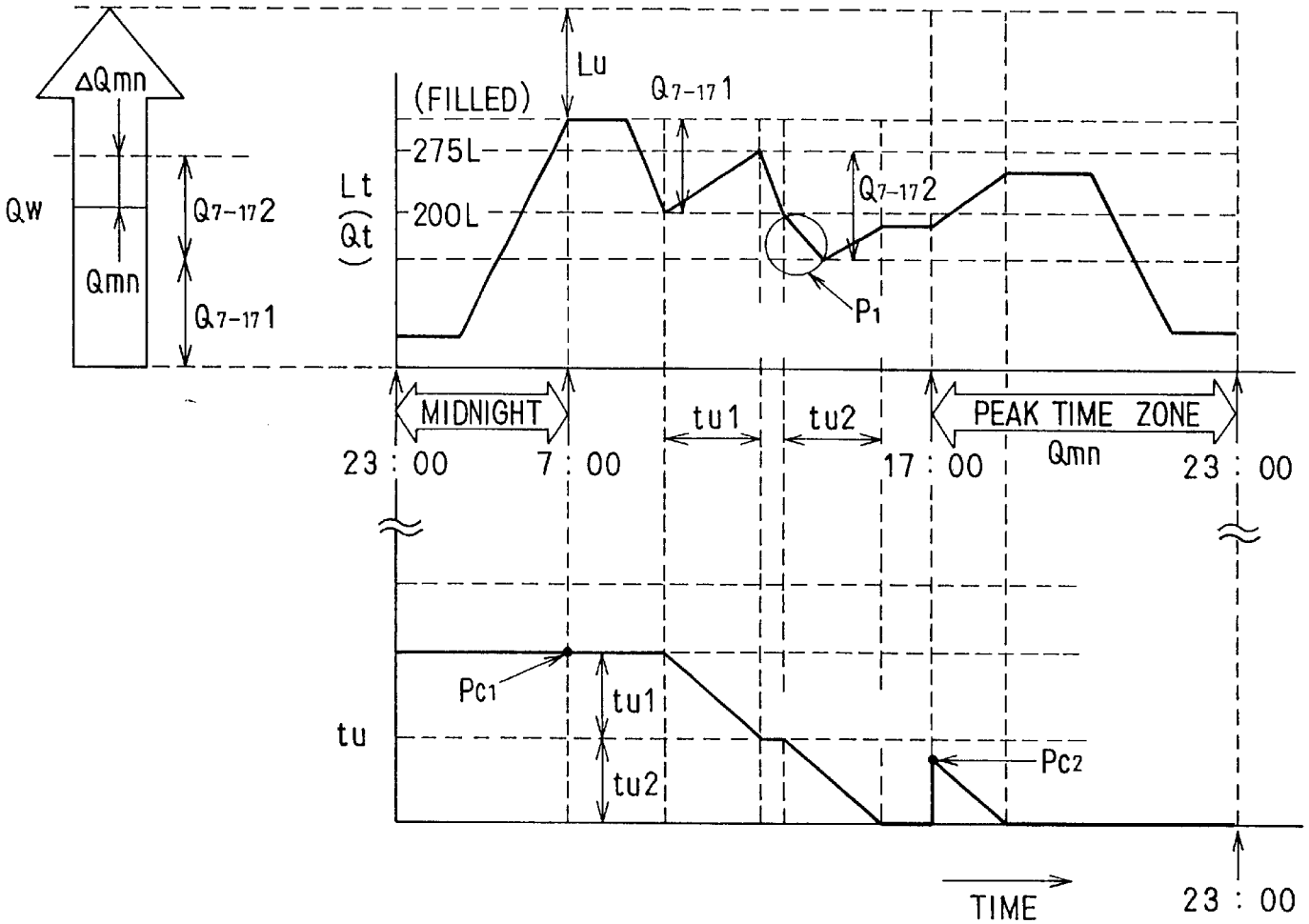
FIG. 10 is an another graph showing a change of the hot-water storage amount Lt (heat storage amount Qt), and a change of the compulsory-boiling time period tu, in a time zone from 7:00 to 23:00, according to the first embodiment.

FIG. 10 shows the compulsory-boiling operation of the hot-water supply system K in the time zone from 7:00 to 17:00 and in the time zone from 17:00 to 23:00. As shown in FIG. 10, when the heat quantity of $Q_{7\text{-}17}1$ and the heat quantity of $Q_{7\text{-}17}2$ are used in the time zone from 7:00 to 17:00, the used heat quantity in the time zone from 7:00 to 17:00 becomes larger than the maximum using heat quantity Qmn. In this case, when the maximum using heat quantity Qmn is used in the time zone from 17:00 to 23:00, the shortage of heat quantity is caused. However, in the first embodiment of the present invention, the compulsory-boiling time tu is additionally calculated at the time of 17:00 (at the point Pc2 in FIG. 10), and the compulsory-boiling operation is additionally performed in the time zone from 17:00 to 23:00. Therefore, it can sufficiently prevent the shortage of hot water in the time zone from 17:00 to 23:00.

Figure 11:
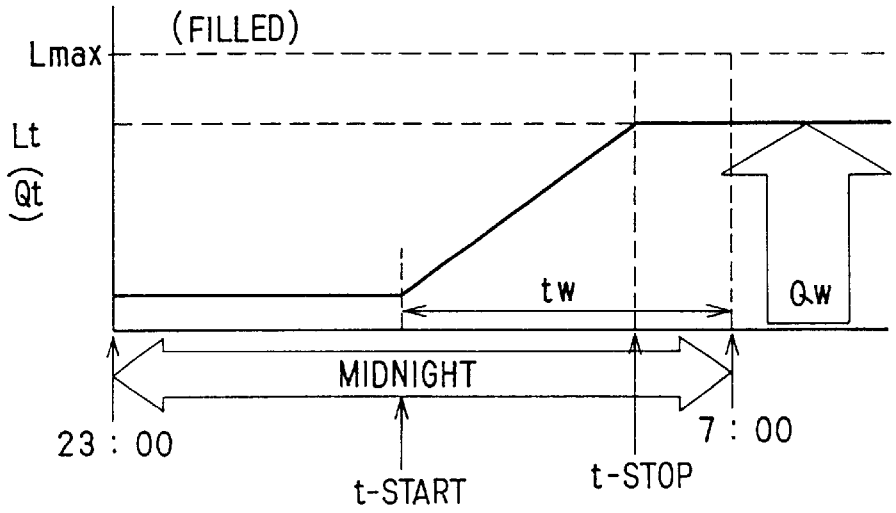
FIG. 11 is a graph showing control operation of a control unit in a hot-water supply system according to a second preferred embodiment of the present invention.

A second embodiment of the present invention will be now described with reference to FIG. 11. In the above-described first embodiment, as shown in FIGS. 7A and 7B, the general-boiling operation is started at the general-boiling start time t-START, and is stopped at the time immediately before the time of 7:00, so that the tanks are fully filled with hot water. However, in the second embodiment of the present invention, as shown in FIG, 11, the general-boiling operation can be stopped at a general-boiling stop time t-STOP before the time of 7:00, when the target heat storage amount Qw is ensured in the midnight time zone. Even in this case, heat loss of the stored hot water can be restricted. In the second embodiment, the other parts are similar to those of the above-described first embodiment.

Figure 12:
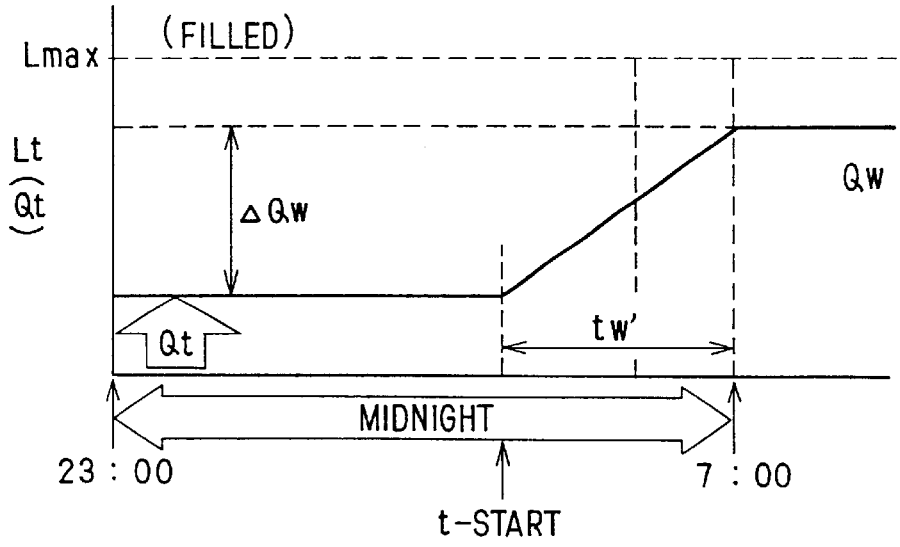
FIG. 12 is a graph showing control operation of a control unit in a hot-water supply system according to a third preferred embodiment of the present invention.

A third preferred embodiment of the present invention will be now described with reference to FIG. 12. In the above-described first embodiment of the present invention, the general-boiling time period tw is set so that the tanks are fully filled with hot water until the time of 7:00. However, in the third embodiment of the present invention, the general-boiling time period tw' is calculated based on a difference ΔQw between the target heat storage amount Qw and the hot-water heat storage amount Qt stored in the tanks. Therefore, the general-boiling operation in the midnight time zone is performed during the general-boiling time period tw' in accordance with a necessary heat quantity, and the general-boiling operation is finished at the time of 7:00.

That is, in the third embodiment of the present invention, the general-boiling tome period tw' is calculated based on the following formulas (20) and (21).

$$Lw=\Delta Qw/[(Tp-5-THWA)\times 4.18\times SP] \quad (20)$$

$$tw'=(Lw-Lt)/[4.5\ \text{kW}/(Tp-THWA)\times 4.18\times SP] \quad (21)$$

wherein, Lw is the necessary boiling amount in the midnight time zone, and SP is a specific gravity.

Accordingly, in the third embodiment of the present invention, the heat loss of the stored hot water can be accurately prevented.

Figure 13:
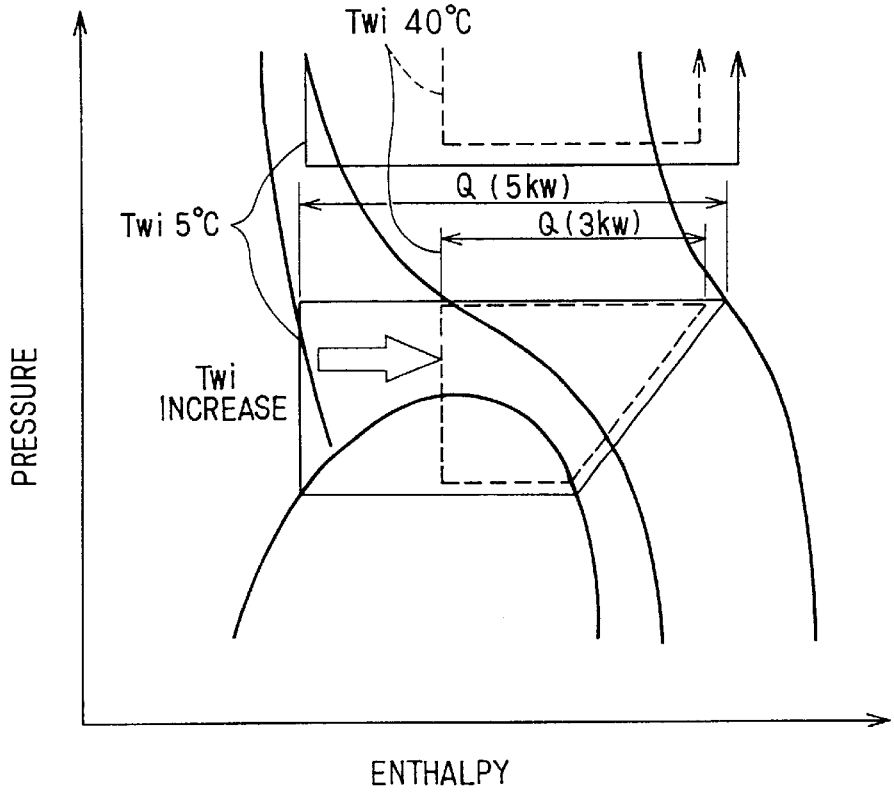
FIG. 13 is a Mollier diagram showing a change of heating capacity Q due to a difference of water supply temperature Twi' according to a fourth preferred embodiment of the present invention.

A fourth preferred embodiment of the present invention will be now described with reference to FIGS. 13 and 14. As shown in FIG. 13, the heating capacity Q (boiling capacity) is changed in accordance with the water supply temperature Twi. Therefore, an accurate calculation of the general-boiling time period Tw becomes difficult. That is, when hot water remains in the tanks 2, 3, the water supply temperature Trwi is changed in the boiling operation, and the heating capacity Q is changed as shown in FIG. 13, thereby the accurate calculation of the general-boiling time period tw becomes difficult. Thus, in the fourth embodiment of the present invention, the temperature in each tank position is detected by the thermistors 22–24 and 31–34, the water temperature distribution in the tanks 2, 3 is detected, and the hot-water storage amount Lt stored in the tanks 2, 3 is calculated.

In addition, the mean supply water temperature THWA for the later 24 hours (e.g., from 23:00 of the previous day to 23:00 of today) is calculated as a standard water supply temperature THWstd (constant), and an estimate water flow amount Gwa is calculated so that the heating capacity Q becomes a standard heating capacity Qstd (constant) by controlling the operation of the compressor of the heat pump unit 1 and the like.

That is, the estimate water flow amount Gwa is calculated based on the following formula (22).

$$Gwa=Qstd/(Tp-THWstd) \quad (22)$$

wherein, Tp is the target boiling temperature.

Next, the general-boiling time period tw is estimated based on the following formula (23).

$$tw=(L-Lt)/Gwa \quad (23).$$

wherein L is the tank capacity (e.g., 300L).

Figure 14:
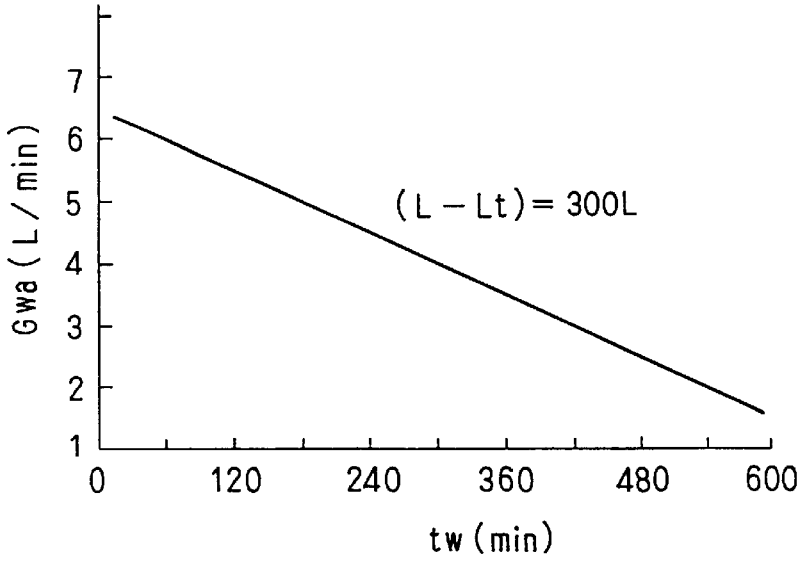
FIG. 14 is a graph showing a relationship between a general-boiling time period tw and a water flow amount Gwa, according to the fourth embodiment.

FIG. 14 shows a relationship between the estimate water flow amount Gwa and the general-boiling time period tw. That is, in the fourth embodiment, the estimate water flow amount Gwa is calculated based on at least one of the target boiling temperature Tp, the standard water supply temperature THWstd and the standard heating capacity Qstd, so that the heating capacity is not changed by the water supply temperature. Therefore, the general-boiling time period tw is accurately estimated using the estimate water flow amount Gwa. The estimate water flow amount Gwa can be calculated based on at least one of the target boiling temperature Tp, the standard water supply temperature THWstd, the standard heating capacity Qstd, and an estimated heat quantity used for hot water supplied during the boiling operation. Even in this case, the necessary boiling time period tw can be accurately calculated.

Although the present invention has been fully described in connection with the preferred embodiments thereof with reference to the accompanying drawings, it is to be noted that various changes and modifications will become apparent to those skilled in the art.

For example, in the home using the hot water more than the maximum hot-water storage amount (300L), when hot water is used in the midnight time zone, the tanks 2, 3 may be not fully filled with hot water at the time of 7:00. Accordingly, in this case, a maximum using heat amount ΔQnt for the last seven days in the midnight time zone is calculated similarly to the calculation of ΔQmn, an additional boiling time period tu for the midnight time zone is calculated, and the general-boiling start time t-START is made early by the additional boiling time period tu.

In the above-described first embodiment of the present invention, the time zone is separated into the midnight time zone (from 23:00 to 7:00), the daytime time zone (from 7:00 to 17:00) and the evening time zone (from 17:00 to 23:00). However, the time zone can be further divided in detail. For example, a time zone for preparing and cleaning meals, a bath-using time zone and the like can be divided, and the boiling operation can be controlled after learning each heat quantity used in each time zone.

Further, heat quantity used on the weekday and heat quantity used on holiday are respectively input as information, and the information can be output from calendar date or can be manually set.

In the above-described fourth embodiment of the present invention, the mean temperature of the preceding day may be used as the standard water temperature, the lowest water temperature in the tank can be used as the standard water temperature, or a water supply temperature estimated from the outside air temperature may be used as the standard water temperature. The standard heating capacity may be estimated based on the outside air temperature, the rotation speed of the compressor and the evaporation temperature and the like. The estimate water flow amount may be estimated only using the standard heating capacity and the target boiling temperature. In this case, the standard heating capacity is the capacity when the water supply temperature is 0° C. Further, the standard water temperature may be estimated based on estimated outside air temperature. The estimated outside air temperature may be changed at different regions.

In the above-described embodiment of the present invention, the heat-pump unit 1 is used for heating water. However, the other water-heating unit operated electrically can be used.

Such changes and modifications are to be understood as being within the scope of the present invention as defined by the appended claims.

What is claimed is:

1. A hot-water supply system comprising:

a tank having a water inlet side to which water from a water supply source is supplied, and a hot-water storing side for storing heated hot water for a supply;

a water-heating unit for heating water introduced from the water inlet side of the tank, and for sending heated hot water to the hot-water storing side of the tank, the water-heating unit being disposed to be electrically operated; and a control unit for controlling operation of the water-heating unit, wherein, the control unit includes use heat-quantity calculating means for calculating a heat quantity used in a predetermined time period based on a hot-water supply amount from the tank in the predetermined time period, and for learning the heat quantity used in the predetermined time period, target heat-quantity calculating means for calculating a target heat quantity for boiling, based on the learned heat quantity in the use heat-quantity calculating means, target temperature calculating means for calculating a target boiling temperature of water, based on the target heat quantity calculated by the target heat-quantity calculating means, and boiling means for performing boiling operation of the water-heating unit by a necessary boiling amount, based on the target boiling temperature calculated from the target temperature calculating means.

2. The hot-water supply system according to claim 1, wherein the control unit further includes time-zone heat-quantity calculating means for calculating and learning a heat quantity used in each time zone, based on each hot-water supply amount during a plurality of time zones in which power rate are different from each other, present heat-quantity calculating means for calculating a heat quantity stored in hot water within the tank at the present time, shortage estimating means for estimating a shortage of the heat quantity stored in hot water within the tank, based on the heat quantity from the time-zone heat quantity calculating means and the heat quantity from the present heat quantity calculating means, and compulsory-boiling means for additionaly performing the boiling operation in accordance with a shortage amount of the heat quantity when the shortage is estimated by the shortage estimating means.

3. The hot-water supply system according to claim 2, wherein:

the time zones includes an evening time zone in which a using amount of hot water is greatly increased than the other time zones;

the control unit performs operations of the time-zone heat-quantity calculating means, the present heat-quantity calculating means, the shortage estimating means and the compulsory-boiling means, at least before the evening time zone.

4. The hot-water supply system according to claim 1, wherein:

the predetermined time period is the last seven days; and the target heat quantity for boiling is a maximum using heat quantity for the last seven days.

5. The hot-water supply system according to claim 1, wherein, when the target boiling temperature calculated by the target temperature calculating means is higher than a predetermined temperature, the boiling means performs the boiling operation even in a time zone except for a midnight time zone which is cheapest in power rate.

6. The hot-water supply system according to claim 5, wherein the control unit includes compulsory-boiling time calculating means for calculating a compulsory-boiling time based on the target boiling temperature and a heat quantity of hot water stored in the tank, when the boiling means performs the boiling operation in the time zone except for the midnight time zone.

7. The hot-water supply system according to claim 1, wherein the boiling means includes boiling time calculating means for calculating a necessary boiling time period for which the boiling operation is performed and the tank is filled with hot water, and boiling-start time calculating means for calculating a boiling-start time based on the necessary boiling time period in such a manner that the boiling operation is finished at a time immediately before a finish time of a midnight time zone which is cheapest in power rate.

8. The hot-water supply system according to claim 7, wherein the boiling time calculating means calculates a water flow amount by using at least one of a standard boiling capacity, the target boiling temperature and a standard water temperature, to calculate the necessary boiling time period.

9. The hot-water supply system according to claim 7, wherein the boiling time calculating means calculates a water flow amount by using at least one of a standard boiling capacity, the target boiling temperature, a standard water temperature and an estimate heat quantity used for hot water supplied during the boiling operation, to calculate the necessary boiling time period.

10. The hot-water supply system according to claim 9, wherein the estimate heat quantity is a maximum heat quantity used for hot water supplied in the boiling operation during the last seven days.

11. The hot-water supply system according to claim 10, wherein the boiling means performs the boiling operation when a heat quantity stored in hot water within the tank at the present time is lower than the target heat quantity for boiling.

12. A hot-water supply system comprising:

a tank having a water inlet side to which water from a water supply source is supplied, and a hot-water storing side for storing heated hot water for a supply;

a water-heating unit for heating water introduced from the water inlet side of the tank, and for sending heated hot water to the hot-water storing side of the tank, the water-heating unit being disposed to be electrically operated; and a control unit for controlling operation of the water-heating unit, wherein, the control unit includes use heat-quantity calculating means for calculating a heat quantity used in a predetermined time period based on a hot-water supply amount from the tank in the predetermined time period, and for learning the heat quantity used in the predetermined time period, target heat-quantity calculating means for calculating a target heat quantity for boiling, based on the learned heat quantity in the use heat-quantity calculating means, first boiling means for performing boiling operation of the water-heating unit based on the target heat quality for boiling, in a midnight time zone which is cheapest in power rate, first boiling time calculating means for calculating a first boiling time period for which the boiling operation is performed and the tank is filled with hot water in the midnight time zone, and boiling-start time calculating means for calculating a boiling-start time in the midnight time zone based on the first boiling time period in such a manner that the boiling operation is finished at a time immediately before a finish time of the midnight time zone.

13. The hot-water supply system according to claim 12, wherein the control unit further includes time-zone heat-quantity calculating means for calculating and learning a heat quantity used in each time zone, based on each hot-water supply amount during a plurality of time zones in which power rate are different from each other, present heat quantity calculating means for calculating a heat quantity stored in hot water within the tank at the present time, shortage estimating means for estimating a shortage of the heat quantity stored in hot water within the tank, based on the heat quantity from the time-zone heat quantity calculating means and the heat quantity from the present heat quantity calculating means, and second boiling means for additionally performing the boiling operation in accordance with a shortage amount of the heat quantity when the shortage is estimated by the shortage estimating means.

14. The hot-water supply system according to claim 13, wherein:

the time zones includes an evening time zone in which a using amount of hot water is greatly increased than the other time zones; and second boiling means performs the boiling operation at least before the evening time zone.

15. The hot-water supply system according to claim 13, wherein the control unit includes a second boiling time calculating means for calculating a second boiling time period for which the boiling operation is performed in a time zone except for the midnight time zone, when the heat quantity of hot water stored in the tank is smaller than a first predetermined value.

16. The hot-water supply system according to claim 15, wherein the second boiling means performs the boiling operation for the second boiling time period until the heat quantity of hot water stored in the tank is increased to a second predetermined value that is smaller than a filled value where the tank is filled with hot water.

17. The hot-water supply system according to claim 12, wherein:

the control unit includes hot-water amount detecting means for detecting a hot-water amount stored in the tank;

as the hot-water amount stored in the tank at a start time of the midnight time zone is smaller, the first boiling time period is set longer and the first boiling start time is set earlier.

18. The hot-water supply system according to claim 12, wherein:

the control unit includes hot-water amount detecting means for detecting a hot-water amount stored in the tank;

as the hot-water amount stored in the tank at a start time of the midnight time zone is larger, the first boiling time period is set shorter and the first boiling start time is set later.

* * * * *